US006577280B2

(12) United States Patent
Kim

(10) Patent No.: US 6,577,280 B2
(45) Date of Patent: Jun. 10, 2003

(54) BUILT-IN ANTENNA DEVICE FOR FOLDER-TYPE PORTABLE RADIO TERMINAL

(75) Inventor: Seong-Yun Kim, Kyonggi-do (KR)

(73) Assignee: Samsung Electronics, Co., Ltd. (KR)

( * ) Notice: Subject to any disclaimer, the term of this patent is extended or adjusted under 35 U.S.C. 154(b) by 0 days.

(21) Appl. No.: 10/039,479

(22) Filed: Nov. 9, 2001

(65) Prior Publication Data

US 2002/0084938 A1 Jul. 4, 2002

(30) Foreign Application Priority Data

Dec. 30, 2000 (KR) ..... 2000-87223

(51) Int. Cl.[7] ..... H01Q 1/24
(52) U.S. Cl. ..... 343/702; 343/866; 343/741
(58) Field of Search ..... 343/702, 741, 343/742, 866, 867; 455/89, 90; H01Q 1/24

(56) References Cited

U.S. PATENT DOCUMENTS

| | | | | | |
|---|---|---|---|---|---|
| 4,992,799 | A | * | 2/1991 | Garay | 343/702 |
| 5,170,173 | A | * | 12/1992 | Krenz et al. | 343/702 |
| 5,451,965 | A | * | 9/1995 | Matsumoto | 343/702 |
| 5,508,709 | A | * | 4/1996 | Krenz et al. | 343/702 |
| 5,542,106 | A | * | 7/1996 | Krenz et al. | 455/90 |
| 5,557,293 | A | * | 9/1996 | McCoy et al. | 343/867 |
| 6,292,145 | B1 | * | 9/2001 | Yu | 343/702 |

* cited by examiner

*Primary Examiner*—Tho Phan
(74) *Attorney, Agent, or Firm*—Dilworth & Barrese, LLP

(57) ABSTRACT

There is provided a built-in antenna device in a folder-type portable radio terminal having a body and a folder mounted to the main body to be rotatable at a predetermined angle with respect to the main body. A metal loop antenna is installed along the peripheral contour of the folder and an electrical connection means electrically connects the loop antenna to an RF (Radio Frequency) board of the main body. Therefore, the radiation performance of the antenna is maximized.

4 Claims, 6 Drawing Sheets

BUILT-IN ANTENNA DEVICE FOR FOLDER-TYPE PORTABLE RADIO TERMINAL

PRIORITY

This application claims priority to an application entitled "Built-In Antenna Device for Folder-Type Portable Radio Terminal" filed in the Korean Industrial Property Office on Dec. 30, 2000 and assigned Serial No. 2000-87223, the contents of which are hereby incorporated by reference.

BACKGROUND OF THE INVENTION

1. Field of the Invention

The present invention relates generally to an antenna device for a folder-type terminal, and in particular, to a built-in antenna device installed within a folder-type portable radio terminal that is separated from the human body by a maximum distance when a user utilizes the terminal to improve the outer appearance of the terminal.

2. Description of the Related Art

As portable radio terminals become commonplace, diverse functions and designs are developed for them. Portable radio terminals designed with a diversity of functions are small and lightweight because it is important to many customers. To satisfy the customers' demand for portable terminals, the terminals must be less bulky while they maintain their functionality at the same level or greater. The most suitable candidate for the miniaturization of radio terminals are folder-type terminals which increasingly have come to the market and are being further, developed to be scaled down and include a variety of functions.

FIG. 1 is a perspective view of a typical folder-type portable radio terminal in an on-hook state and FIG. 2 is a perspective view of the typical folder-type portable radio terminal in an off-hook state.

Referring to FIGS. 1 and 2, the folder-type portable radio terminal is comprised of a main body 1000, a folder 2000, and a hinge device within arm 2030 that mechanically connects the main body 1000 to the folder 2000 at an angle where a user is able to utilize the portable radio terminal to communicate with other radio terminals.

The main body 1000 includes an upper casing frame 1001, a lower casing frame 1002, an antenna device 1010, side arms 1015*a* and 1015*b*, an incoming call lamp 1016, a keypad 1020 and a microphone 1030. Antenna device 1010 is located at the uppermost side of the main body 1000. Keypad 1020 includes a plurality of function keys and digit keys. Microphone 1030 and keypad 1020 are sequentially arranged under the antenna device 1010. Side arms 1015*a* and 1015*b* are formed between the antenna device 1010 and the keypad 1020, on the main body 1000, and a slot 1017 is defined between the side arms 1015*a* and 1015*b*. Incoming call lamp 1016 is disposed on one side arm 1015*b*.

The folder 2000 includes an earpiece 2010, a Liquid Crystal Display 2020 and a cylindrical center hinge arm 2030.

Earpiece 2010, including a speaker, is located on the uppermost part of the folder 2000 rotatably connected to the main body 1000 by the cylindrical center hinge arm 2030. LCD (Liquid Crystal Display) module 2020, is disposed under the earpiece 2010.

Cylindrical center hinge arm 2030 is installed in the slot 1017 under the folder 2000. A hinge device is provided in the cylindrical center hinge arm 2030. Therefore, the folder 2000 rotates on a rotating axis A1 with respect to the main body 1000.

The antenna device 1010 is preferably a combination of a helical antenna electrically connected to an RF (Radio Frequency) board of the main body 1000 and a whip antenna (rod antenna) extendable from the helical antenna.

Since the antenna device 1010 is installed on the main body 1000, it is near to the human body when a user uses the terminal, thereby deteriorating the performance of the radio terminal. Due to the protrusion of the antenna device 1010 outside the terminal, the antenna device 1010 is vulnerable to damage when the terminal is dropped and the antenna can also become a nuisance when the user carries the terminal.

For example, a user may be bothered when he has to constantly extend the antenna of his mobile terminal in order to obtain a good transmission signal to receive or send a message.

SUMMARY OF THE INVENTION

It is, therefore, an object of the present invention to provide a built-in antenna device that is so installed within a folder-type portable radio terminal as to contribute to the miniaturization of the folder-type portable radio terminal.

It is another object of the present invention to provide a built-in antenna device that is installed at the periphery of a folder-type portable radio terminal, which prevents deterioration of the performance the radio terminal caused by a human body contacting the antenna device body.

It is a further object of the present invention to provide a built-in antenna device that is disposed in the folder of a folder-type portable radio terminal in order to be separated from a human body by a maximum distance.

The foregoing and other objects are achieved by a built-in antenna device in a folder-type portable radio terminal having a body and a folder mounted to the main body to be rotatable at a predetermined angle with respect to the main body. A metal loop antenna is installed along the peripheral contour of the folder and an electrical connection means electrically connects the metal loop antenna to an RF board of the main body.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF THE PREFERRED EMBODIMENT

A preferred embodiment of the present invention will be described hereinbelow with reference to the accompanying drawings. In the following description, well-known functions or constructions are not described in detail since they would obscure the invention in unnecessary detail.

Figure 1:
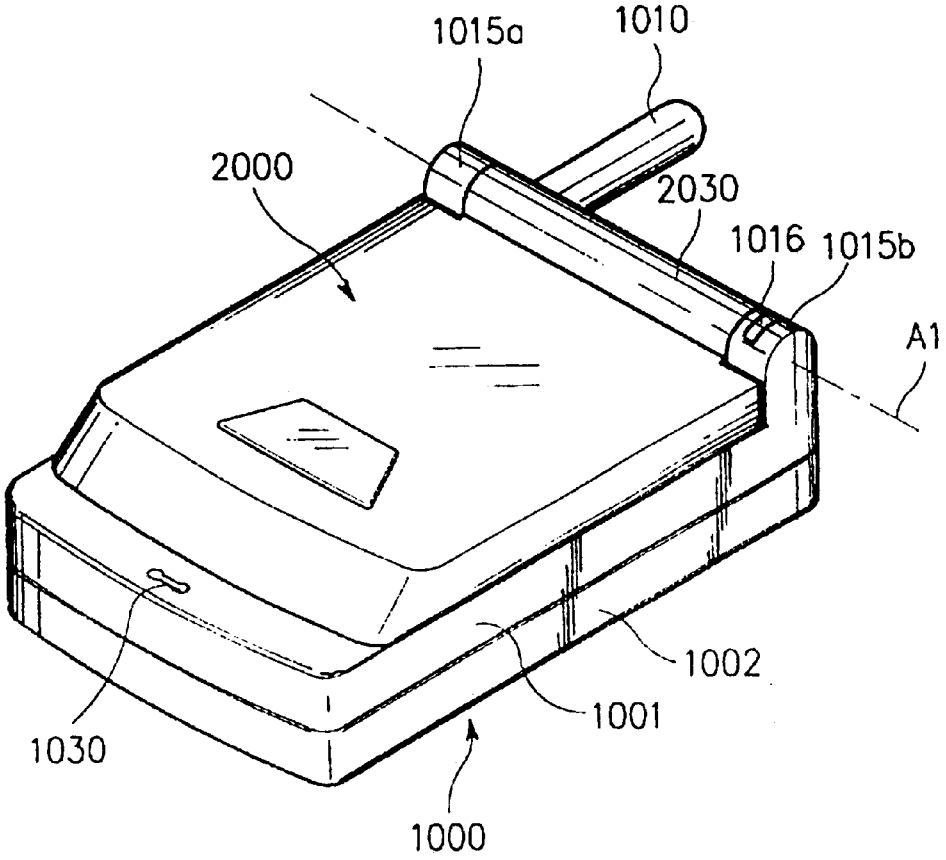
FIG. 1 (PRIOR ART)
FIG. 1 is a perspective view illustrating a typical folder-type portable radio terminal in an on-hook state.
Figure 2:
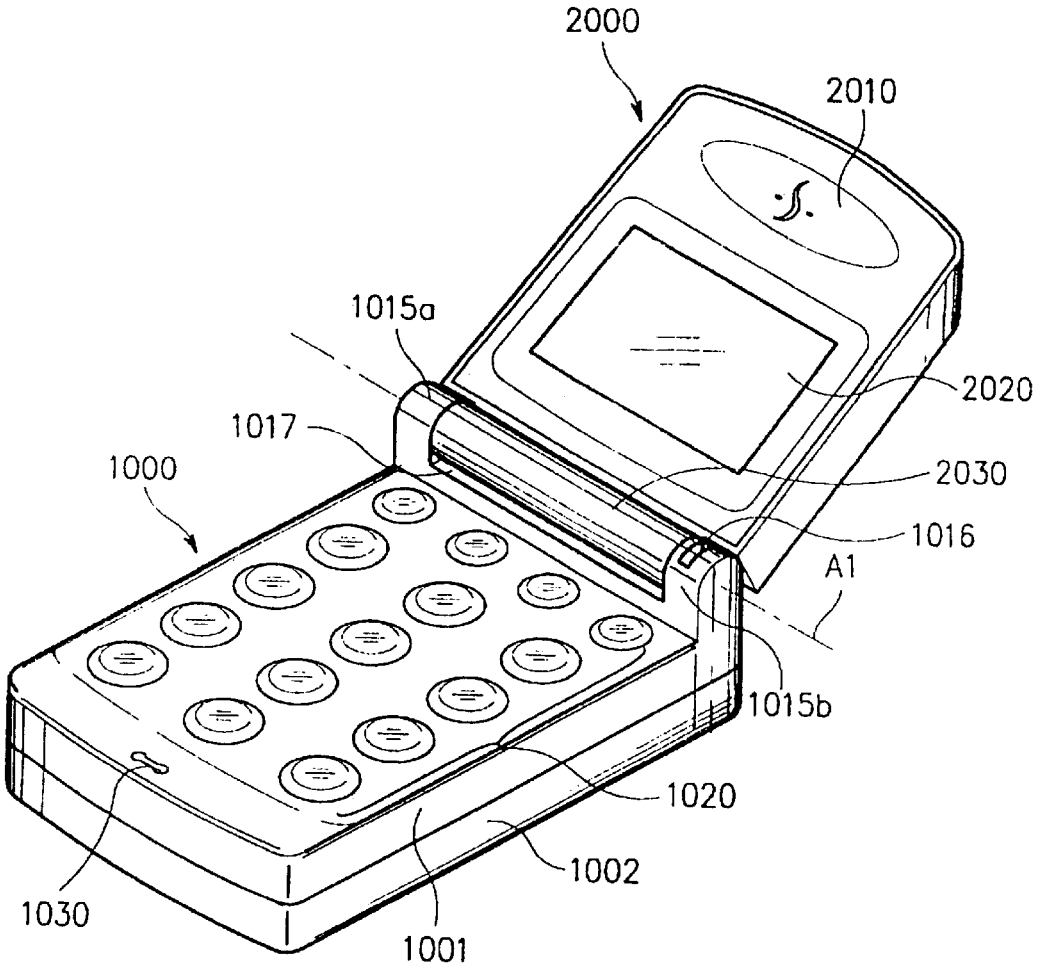
FIG. 2 (PRIOR ART)
FIG. 2 is a perspective view illustrating the typical folder-type portable radio terminal in an off-hook state.
Figure 3:
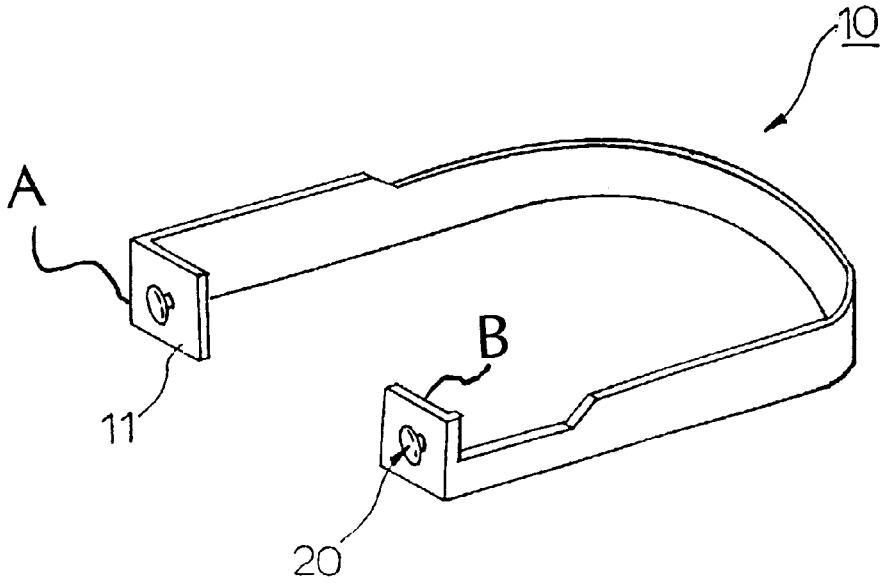
FIG. 3 is a perspective view illustrating a built-in antenna, according to an embodiment of the present invention.
Figure 4:
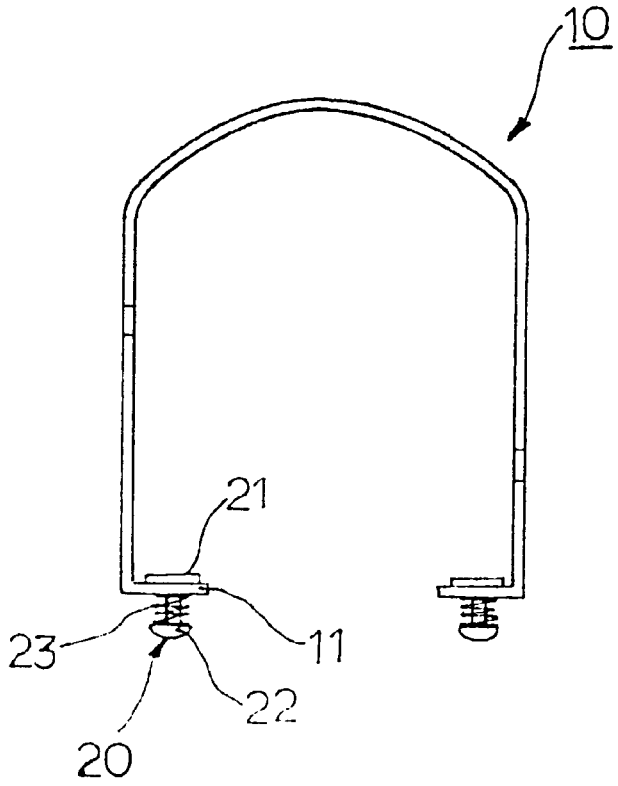
FIG. 4 is a plan view illustrating the built-in antenna, according to the embodiment of the present invention.

FIGS. 3 and 4 are respectively a perspective view and a plan view of a built-in antenna according to an embodiment of the present invention.

Figure 6:
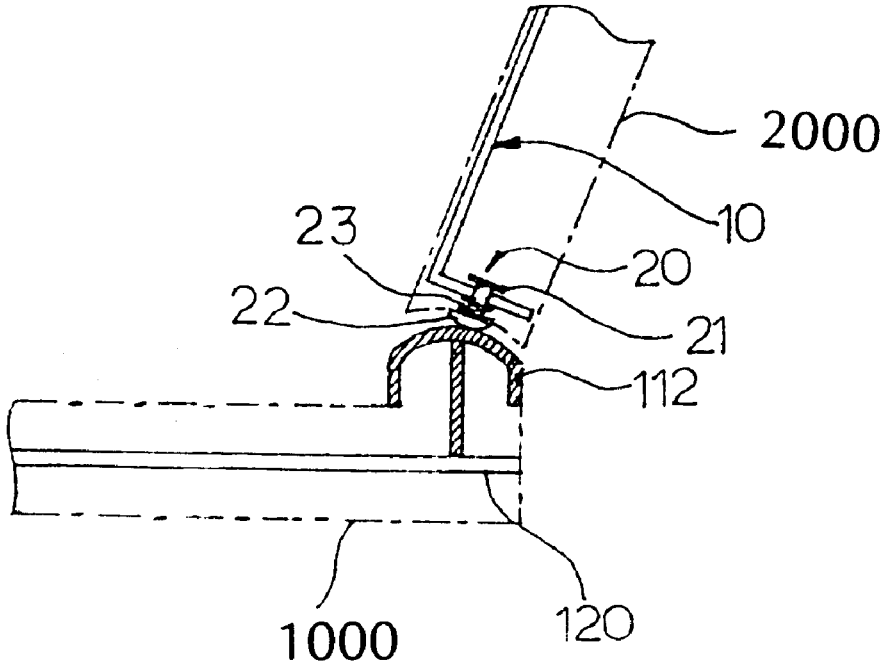
FIG. 6 is a partial side view of the terminal with the built-in antenna according to the embodiment of the present invention, installed therein.

Referring to FIGS. 3 and 4, a loop antenna 10, formed by bending a metal plate in a predetermined shape, is used as the built-in antenna, according to the present invention. Bending portions 11 are extended inwardly from both ends of the loop antenna 10. Electrical connectors 20 are provided on the bending portions 11 for electrical connection with an RF board 120, as shown in FIG. 6, on a main body 1000. As best seen in FIG. 3, the loop antenna has a relatively uniform thickness along its entire length, while the height of the loop antenna varies along the length from a first end A to a second end B.

At least two connection portions 20 are provided as the electrical connectors on the bending portions 11 and pressure is applied onto the connection portions 20 outwardly from the loop antenna 10. Each connection portion 20 has an engagement portion 21 at one end and a head 22 at the other end. The engagement portion 21 and the head 22 being greater in diameter than the inserted portion of the connection portions 20 are utilized to prevent the outward deviation of each connection portions 20. The heads 22 are curved for active electrical connection. To apply pressure to the at least two connection portions 20 outwardly with respect to the loop antenna 10, a coil spring 23 is inserted between the heads 22 of each connection portions 20 and the bending portion 11 that the connection portion 20 is inserted into. The coil spring 23 may be a compressed coil spring.

Figure 5:
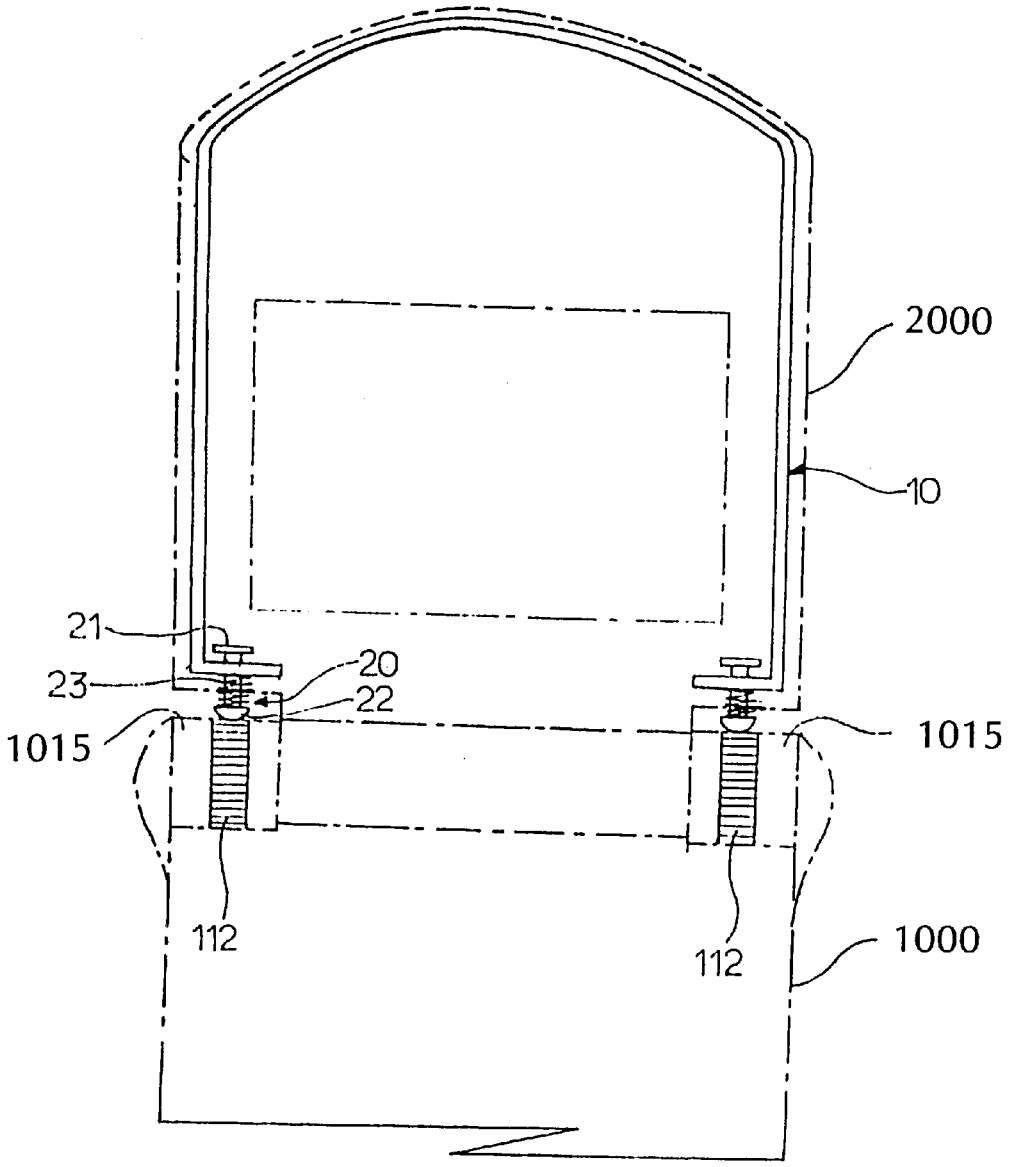
FIG. 5 is a plan view illustrating a terminal with the built-in antenna, according to the embodiment of the present invention, installed therein.

FIG. 5 is a plan view of the built-in antenna mounted to a terminal and FIG. 6 is a partial side view of the built-in antenna mounted to the terminal according to the embodiment of the present invention. Referring to FIGS. 5 and 6, the loop antenna 10 is mounted at the periphery of the folder 2000. The connection portions 20 protrude inwardly from both sides of the folder 2000 so that the heads 22 of the connection portions 20 contact the surfaces of at least two metal plates 112 exposed on the side hinge arms 1015. Since the coil springs 23 press the connection portions 20 outwardly from the loop antenna 10, the connection portions 20 are in contact with the metal plates 112.

As shown in FIG. 6, the metal plates 112 are electrically connected to the RF board 120 of the main body 1000. Therefore, the loop antenna 10 is electrically connected to the RF board 120 of the main body 1000 through the connection portions 20 and the metal plates 112.

As described above, the built-in antenna, according to the embodiment of the present invention, is located at the periphery of the folder in the terminal so that it is separated from a human body by a maximum distance. Therefore, the radiation performance of the antenna is maximized. Furthermore, the built-in configuration of the antenna eliminates the inconvenience encountered when carrying a terminal with a protruded antenna and improves the outer appearance of the terminal.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A built-in antenna device in a folder-type portable radio terminal having a main body and a folder mounted to the main body at a hinge, the folder being rotatable about said hinge at a predetermined angle with respect to the main body, comprising:

a loop antenna installed along a peripheral contour of the folder, the loop antenna having a relatively uniform thickness and a height that varies along a length of the loop antenna; and connection means on the hinge for electrically connecting the loop antenna to an RF (Radio Frequency) board of the main body.

2. The built-in antenna device of claim 1, wherein the connection means comprises:

at least two metal plates exposed on side hinge arms of the main body, one side of each metal plate of the at least two metal plates being electrically connected to the RF board; and at least two connection portions each having one end in contact with one of the metal plates and the other end supported by an end of the loop antenna.

3. The built-in antenna device of claim 2, wherein an end of each connection portion is formed into an engagement portion inserted into a bent portion at an end of the loop antenna to prevent deviation of the connection portion, the other end of the each connection portion is formed into a curved head to reliably contact one of the metal plates, and a coil spring is inserted between the head and the bent portion of the loop antenna to press each connection portion toward the metal plate.

4. The built-in antenna device of claim 1, wherein the loop antenna is formed into a shape similar to the peripheral contour of the folder.

* * * * *